US008840359B2

(12) United States Patent
Vick et al.

(10) Patent No.: US 8,840,359 B2
(45) Date of Patent: Sep. 23, 2014

(54) THERMALLY INSULATING TURBINE COUPLING

(75) Inventors: Michael J. Vick, Vienna, VA (US); Keith R. Pullen, London (GB)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 413 days.

(21) Appl. No.: 13/272,941

(22) Filed: Oct. 13, 2011

(65) Prior Publication Data

US 2012/0093661 A1 Apr. 19, 2012

Related U.S. Application Data

(60) Provisional application No. 61/392,820, filed on Oct. 13, 2010.

(51) Int. Cl.
*F04D 25/04* (2006.01)
*F04D 29/054* (2006.01)

(52) U.S. Cl.
CPC ..... *F04D 29/054* (2013.01); *F04D 25/04* (2013.01)
USPC ..... 415/1; 415/122.1; 415/177; 415/216.1

(58) Field of Classification Search
CPC ..... F01D 5/02; F01D 25/08
USPC ..... 415/177, 178, 179, 180, 216.1, 122.1, 415/140, 1
See application file for complete search history.

(56) References Cited

U.S. PATENT DOCUMENTS

| | | | | | |
|---|---|---|---|---|---|
| 4,198,192 | A | * | 4/1980 | Webb | 417/373 |
| 4,281,941 | A | | 8/1981 | Rottenkolber | |
| 4,518,315 | A | * | 5/1985 | Kruger | 416/241 B |
| 4,639,194 | A | * | 1/1987 | Bell et al. | 416/241 B |
| 4,784,574 | A | * | 11/1988 | Tsuno et al. | 416/241 B |
| 4,798,493 | A | * | 1/1989 | Oda et al. | 403/404 |
| 4,850,802 | A | * | 7/1989 | Pankratz et al. | 416/213 R |
| 4,856,970 | A | * | 8/1989 | Oda et al. | 417/407 |
| 4,874,674 | A | * | 10/1989 | Oda et al. | 428/469 |
| 4,908,256 | A | * | 3/1990 | Oda et al. | 428/133 |

(Continued)

FOREIGN PATENT DOCUMENTS

| | | | | |
|---|---|---|---|---|
| JP | 60243302 | A | * | 12/1985 |
| JP | H08-004501 | A | | 1/1996 |
| JP | 2002206402 | A | * | 7/2002 |

OTHER PUBLICATIONS

International Search Report for PCT/US11/056193 mailed on Feb. 28, 2012.

(Continued)

*Primary Examiner* — Edward Look
*Assistant Examiner* — Wayne A Lambert
(74) *Attorney, Agent, or Firm* — US Naval Research Laboratory; Kerry L. Broome

(57) ABSTRACT

A rotor assembly, including at least one driven member, e.g., a compressor rotor, and at least one driving member, e.g., a turbine. At least one rotating thermal insulator rigidly attached to either the driven member or the driving member. A coupling feature that includes mating geometric surfaces on the driven member and the driving member, wherein the geometric surfaces are configured to allow radial sliding, relative centering, torque transmission, and axial constraint between the driven member and the driving member.

9 Claims, 4 Drawing Sheets

(56) References Cited

U.S. PATENT DOCUMENTS

| | | | | |
|---|---|---|---|---|
| 4,915,589 | A * | 4/1990 | Gessler et al. | 416/241 B |
| 4,934,138 | A * | 6/1990 | Boyd | 60/806 |
| 4,942,999 | A * | 7/1990 | Oda et al. | 228/124.7 |
| 4,962,002 | A * | 10/1990 | Yoshida et al. | 428/609 |
| 5,028,162 | A * | 7/1991 | Tsuno et al. | 403/30 |
| 5,161,908 | A * | 11/1992 | Yoshida et al. | 403/29 |
| 5,585,163 | A * | 12/1996 | Yoshikawa et al. | 428/133 |
| 6,499,969 | B1 * | 12/2002 | Tombers et al. | 417/407 |
| 6,652,228 | B2 * | 11/2003 | Tiemann | 415/178 |
| 6,723,276 | B1 | 4/2004 | Cooper | |
| 6,896,479 | B2 * | 5/2005 | Svihla et al. | 415/104 |
| 7,155,824 | B2 | 1/2007 | Prucher | |
| 7,527,479 | B2 * | 5/2009 | Shi et al. | 416/241 R |
| 7,777,363 | B2 | 8/2010 | Wang et al. | |
| 2007/0071545 | A1 * | 3/2007 | Schenk | 403/28 |
| 2009/0214331 | A1 * | 8/2009 | Jewess et al. | 415/198.1 |

OTHER PUBLICATIONS

Notification of Reasons for Rejection from the Japan Patent Office mailed on Mar. 18, 2014.

* cited by examiner

THERMALLY INSULATING TURBINE COUPLING

CROSS-REFERENCE TO RELATED APPLICATIONS

This application claims priority to U.S. Provisional Patent Application entitled, "Thermally Insulating Turbine Coupling," filed on Oct. 13, 2010, and assigned U.S. Application No. 61/392,820; the entire contents of which are hereby incorporated by reference.

FIELD OF THE INVENTION

The invention relates to turbine rotors. More specifically, the invention relates to providing a strong, precise, thermally insulating, thermal stress resistant method for joining a turbine rotor to a metal shaft.

BACKGROUND

Ceramic turbines are of interest for high-efficiency gas turbine engines because ceramic materials can tolerate higher temperatures than metals, leading directly to higher fuel efficiency. However, despite extensive research, ceramic turbines are not yet used in production engines due to several problems.

One major problem with ceramic turbines is structural reliability. Due to the lower fracture toughness (brittleness) of ceramic materials, small internal flaws or cracks have a greater tendency to grow over time when the material is under stress, eventually leading to failure. The larger the initial flaw or crack, the greater the propagation rate and the sooner the part will fail. However, if the initial flaw is smaller than a certain size, the "critical flaw size," it will not grow at all, and the part will remain strong. Physically small turbine rotors have an advantage in this regard, as small flaws are easier to detect in small parts because they are larger relative to the overall size of the part. Additionally, if flaws follow a probabilistic distribution, as is typical for ceramics, then the probability of a greater-than-critical-size flaw occurring in a small part is lower, so the smaller turbine rotor is more likely to be flaw-free initially. Therefore, to those skilled in the art, small turbines are considered much more compatible with ceramic materials than large engines.

However, physically small turbine rotors also have their limitations. Small turbine rotors, particularly those with ceramics, high turbine inlet temperatures, and brazed joints, typically suffer from bearing overheating. In a large engine, the bearings are positioned at a relatively long distance away from the turbine rotor—many inches or even several feet—so it is easier to keep them cool. In contrast, small gas turbines, e.g., those producing under 30 kilowatts of shaft or electric power, typically have complete main shaft assemblies less than ten inches long. Therefore, at least one of the two main bearings must unavoidably be positioned inches from the hot turbine rotor, which makes bearing cooling a very difficult engineering problem. The higher the turbine inlet temperature, the more difficult the cooling problem. Ceramic turbines are only used when a very high turbine inlet temperature is desired, so invariably, bearing cooling is an extraordinarily difficult design challenge in these cases.

In large engines, the bearing overheating problem is typically solved by having oil supply systems and oil coolers. Therefore, in these large engines, it is generally convenient to use the oil to keep the bearings cool, as well as to lubricate them. However, in small, simple engines, this is approach is undesirable because it makes the engine more complex; and thus, more expensive and more prone to failure.

Despite the complexities of the oil systems, almost all small engines, like large engines, use the lubrication system to keep the bearings cool. Typically, they utilize a system to spray a mixture of fuel and oil on the bearings in a "total-loss" lubrication system. To simplify the system, they typically will mix all of the fuel with oil, so that a single fuel/oil pump can supply the bearings and the main combustor with fuel/oil mixture. However, this system tends to lead to additional problems, such as carbon formation, smoke generation in the combustor, and fuel injector coking.

In total loss systems, after going through the bearing, the fuel/oil mix must flow into the combustor and burn. This requirement forces the bearings to be positioned near the combustor, exacerbating the thermal problems. Because of these constraints, small turbine engine bearings typically operate at steady-state temperatures around 300 degrees Celsius, which greatly reduces their load capacity and increases the wear rate. Most small engine bearings need to be replaced approximately every 25 hours. With higher operating temperatures and ceramic materials, this already short life would surely be reduced even further.

Another major problem with ceramic turbines has been the difficulty in joining ceramic turbine rotors to metal shafts. Ceramic materials that have good high-temperature strength and creep properties have a much lower coefficient of thermal expansion (CTE) than metals. For example, silicon nitride ($Si_3N_4$), known to those skilled in the art as presently the best turbine-grade ceramic, has a CTE of 3.1 μm/(m*K). However, a typical stainless steel shaft material has a CTE in the 11-17 μm/(m*K) range. Therefore, when the turbine and shaft get hot, the metal can grow 4-5 times as much as the mating ceramic part. If the ceramic turbine and metal shaft are bonded together rigidly, this can cause large stresses that can break the ceramic material or yield the metal, causing the joint to fail.

On the other hand, if the ceramic turbine and metal shaft are not bonded rigidly, they can move relative to each other. This configuration could be acceptable if the geometry of the joint ensures that the turbine rotor and shaft remain concentric and strongly connected, both during operation and after repeated start/stop cycles. However, cylindrical joints, which are typically the most common type of joint most likely due to its apparent simplicity, cannot maintain concentricity and strength when the two cylindrical parts repeatedly move relative to each other. Therefore, cylindrical joints that move during operation can quickly fail.

One solution to avoid this problem can be to replace the steel shaft with a ceramic, or at least a low-CTE metal, so that the two shafts could have nearly equal CTEs; and therefore, would most likely not generate large thermal stresses. However, the substitution of the ceramic shaft approach is rarely used for various reasons. For example, at room temperature, metals are stronger and tougher than ceramics. They are also far more easily machined to precise tolerances in complex shapes such as gears, splines, keyways, and other typical features of rotating shafts. Furthermore, other metal parts, such as bearings, must invariably be mounted on the shaft. These mounted parts also need to have a close CTE match with the shaft in order to maintain a tight fit that does not loosen as the shaft heats up during operation. For all these reasons, shafts made from steel, or other strong/tough/machinable metal with a CTE value near steel, are typically preferable to ceramic shafts; and therefore, are used almost universally.

In the prior art, ceramic turbines have been mated to metal shafts successfully in the past. The most common joining method is brazing. In this method, an "active filler metal" with a lower melting point than either base material is used to bond the ceramic to the metal substrate, similar to how solder is used to join electrical wires. The filler metal is heated beyond its melting point, flows into the space between parts, and when it solidifies, adheres, and bonds to both the metal and the ceramic. This process only works if the filler metal "wets" both materials, which is a constraint that severely limits the range of choices for the filler metal. To provide thermal strain tolerance, the filler metal should also have a CTE somewhere between the CTEs of the parts being bonded, which is another limiting constraint. Finally, the filler metal should be relatively soft, i.e., low Young's modulus, in order to provide a small amount of compliance to the joint.

Few filler metals are available that have all of these properties. The current state of this technology as provided at azom.com, states that, "The majority of the commercial active metal brazes have been developed for moderate temperature use up to –450° C. However, one of the many attractive properties of ceramics is their ability to survive high temperatures—for example, alumina typically has an upper use temperature of 1700° C. The braze alloys used therefore need to have higher temperature capability than is currently available. One method is to coat the ceramic with either a reactive or refractory metal (WMo, Ta, Cr) then braze using high temperature braze alloys, such as palladium and platinum-based systems. This . . . has been used successfully for joining many high temperature ceramics.

Therefore, according to the prior art, brazed joints must be designed carefully using finite element analysis (FEA) to analyze the stresses generated during thermal expansion. The geometry of the joint, the thickness of the filler metal layer, and the cleaning and fixturing of the bore and shaft during the brazing operation are all critical. Therefore, if not done properly, the process can result in joint failure.

Despite all these limitations, brazing remains the most common method of joining metal and ceramic shafts. However, the problem of keeping the bearings cool still exists, particularly for small engines as explained above. In a brazed shaft joint, the metal, the ceramic, and the filler are all typically good heat conductors. (It should be noted that while some ceramics are insulators, silicon nitride is not. Its thermal conductivity typically exceeds 20 W/m-K, which is on the same order as steel.) Furthermore, to ensure sufficient room for a high-strength bond, with a thick enough filler metal layer to allow for some strain tolerance, the size of the joint must be fairly large. Therefore, the result is that the cross sectional area for heat conduction is also large. Since shaft dynamics considerations limit the maximum length of the shaft overall, and in particular the maximum distance between the turbine rotor and the bearing, it is not possible to simply use a long shaft to insulate the bearing from this heat conducted from the turbine. It is also difficult to squeeze a thermally insulating feature into this very constrained space on the shaft.

A final problem with brazed joints is that they cannot be disassembled. Bearings on high-speed shafts must fit very tightly, to minimize play and ensure concentricity. Therefore, once assembled, the entire rotating assembly can be especially difficult to take back apart. This can make it very difficult to design a gas turbine engine that can readily be repaired easily and quickly.

In summary, brazed and adhesively bonded joints are permanent, and cannot be easily disassembled. They can be difficult to design manufacture, and they typically conduct too much heat to the bearings, which is unavoidable due to shaft dynamics considerations. This problem is particularly severe in small engines; and therefore, the bearings of ceramic turbine engines, particularly small ones, tend to fail often and need frequent replacement.

Accordingly, there remains a need for an alternative method of joining ceramic turbine rotors to metal shafts. Preferably, this new method would allow thermal strains to be accommodated, to limit stresses. It would ideally provide for quick and easy disassembly/reassembly. When assembled, the joint could assure very precise alignment and concentricity between all rotating components. However, the geometry of the joint should also accommodate thermal strains that inevitably arise due to different thermal expansion coefficients and heating/cooling rates of the mating components. Finally, the joining method should ideally provide a significant amount of thermal insulation, in order to allow the bearing near the turbine rotor to remain relatively cool, even while the engine is running.

SUMMARY OF THE INVENTION

The invention satisfies the above-described and other needs by providing for a rotor assembly that can include at least one driven member, e.g., a compressor rotor, and at least one driving member, e.g., a turbine. The rotor assembly also includes at least one rotating thermal insulator rigidly attached to either the driven member or the driving member, which can be made of a ceramic material. Finally, a coupling feature can be provided that includes mating geometric surfaces on the driven member and the driving member, wherein the geometric surfaces are configured to allow radial sliding, relative centering, torque transmission, and axial constraint between the driven member and the driving member. The coupling feature can be a taper bore and hex coupling mechanism, or a Hirth Serration coupling mechanism.

According to another aspect of the invention, a method of reducing heat transfer in a rotor assembly can be provided. A rotating thermal insulator can be rigidly attached to either a driven member or a driving member. Then the driven member can be coupled to the driving member with a coupling feature. The coupling feature can be configured to allow radial sliding, relative centering, torque transmission, and axial constraint between the driven member and the driving member.

According to another aspect of the invention, a rotor assembly can be provided that includes at least one driven member and at least one driving member. Additionally, at least one rotating insulator can be provided that is rigidly attached to either the driven member or the driving member. A coupling feature that includes mating geometric surfaces on the driven member and the driving member can be provided, wherein the geometric surfaces can be configured to allow the driven member and the driving member to thermally expand and contract at different rates, maintain relative centering, and prevent relative rotation. Finally, a means to maintain an axial force between the driven member and the driving member can be provided.

These and other aspects, objects, and features of the present invention will become apparent from the following detailed description of the exemplary embodiments, read in conjunction with, and reference to, the accompanying drawings.

BRIEF DESCRIPTION OF THE DRAWINGS

FIG. 3(*b*) is section view of the exemplary rotor assembly for a gas turbine engine, in accordance with an exemplary embodiment of the invention.

FIG. 3(*c*) is another section view of the exemplary rotor assembly for a gas turbine engine, in accordance with an exemplary embodiment of the invention.

FIG. 6(*b*) is section view of the exemplary rotor assembly for a gas turbine engine, in accordance with an alternative exemplary embodiment of the invention.

DETAILED DESCRIPTION OF EXEMPLARY EMBODIMENTS

Figure 1:
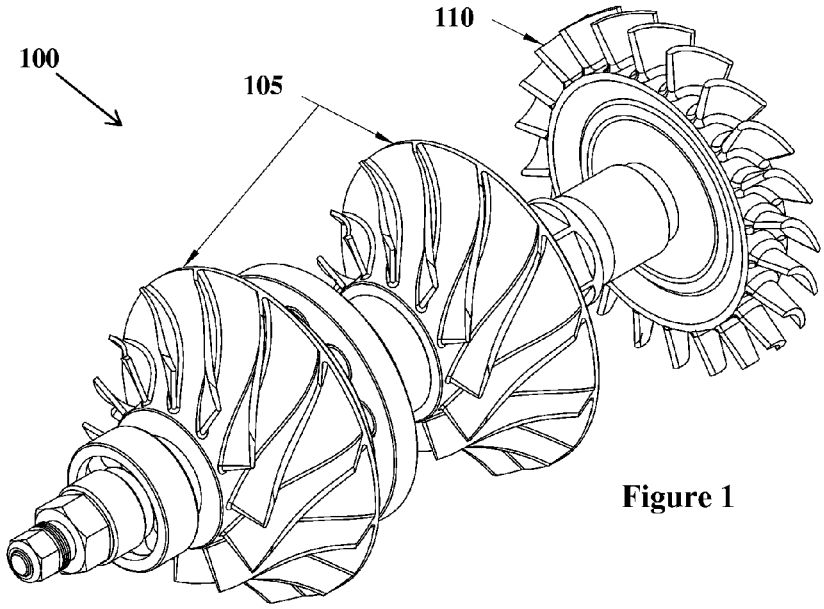
FIG. 1 shows an isometric view of an exemplary rotor assembly for a gas turbine engine, in accordance with an exemplary embodiment of the invention.

Referring now to the drawings, in which like numerals represent like elements, aspects of the exemplary embodiments will be described in connection with the drawing set.

FIG. 1 is an isometric view of an exemplary rotor assembly 100 for a gas turbine engine, in accordance with an exemplary embodiment of the invention. The rotor assembly 100 includes a two-stage compressor impeller assembly 105 and a single stage axial flow turbine rotor 110. However, one of ordinary skill in the art would understand that a rotor assembly with different types, and different quantities, of components could also be utilized so long as there is at least one high speed, high-temperature rotating component such as a turbine, and at least one high speed rotating component that needs to stay comparatively cool, such as a compressor, generator, gearbox, etc. Furthermore, it is immaterial whether the compressor has a single stage or multiple stages, and whether it is centrifugal, axial, or mixed flow. The turbine can also include one or more axial or radial flow stages. In a preferred embodiment, the turbine rotor 110 can be made from a ceramic material. However, in an alternative embodiment, the turbine rotor 110 can be made from a metal.

Figure 2:
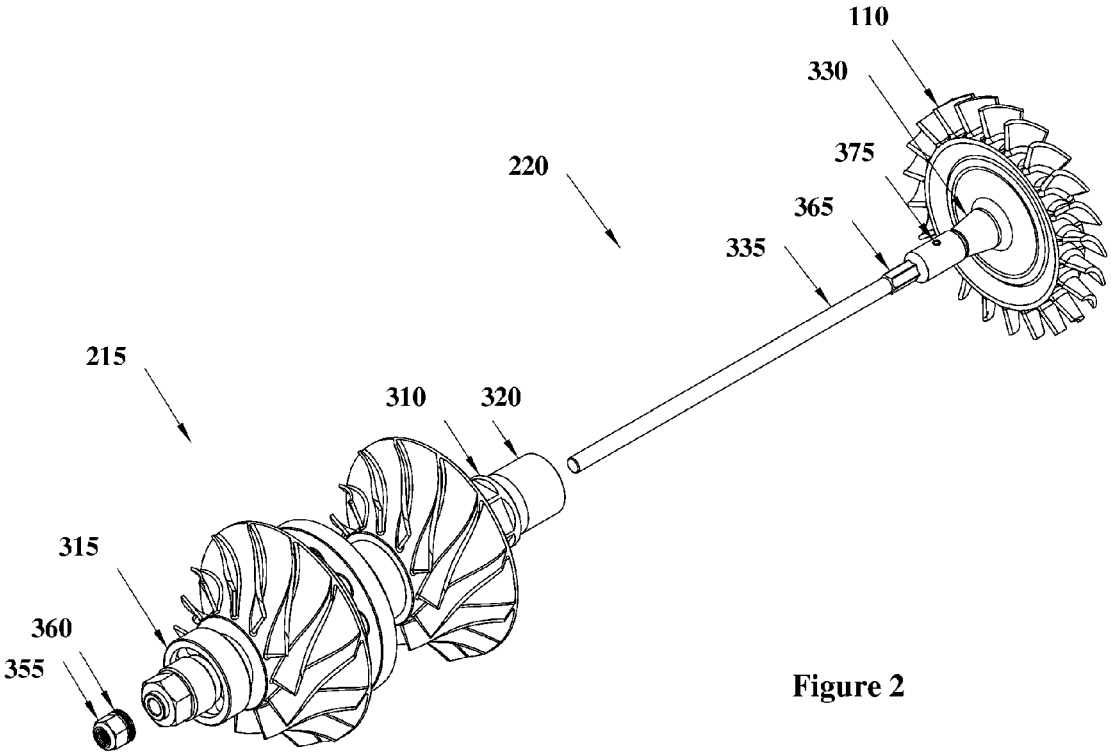
FIG. 2 is an exploded view of the exemplary rotor assembly for a gas turbine engine, in accordance with an exemplary embodiment of the invention.

FIG. 2 is an exploded view of the exemplary rotor assembly 100 for a gas turbine engine, in accordance with an exemplary embodiment of the invention. In FIG. 2, the view reflects the rotor assembly 100 after separating it into two main subassemblies: a main rotating shaft subassembly 215, and a turbine rotor/tension bolt subassembly 220. The remaining reference numbers in FIG. 2 will be discussed in more detail in reference to FIGS. 3(*a*), 3(*b*), and 3(*c*).

Figure 3A:
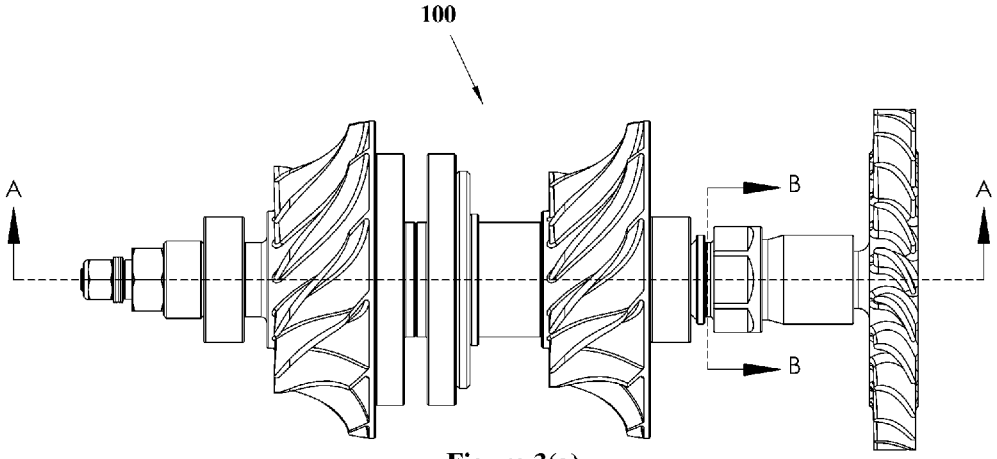
FIG. 3(*a*) is a side view of the exemplary rotor assembly for a gas turbine engine, in accordance with an exemplary embodiment of the invention.
Figure 3B:
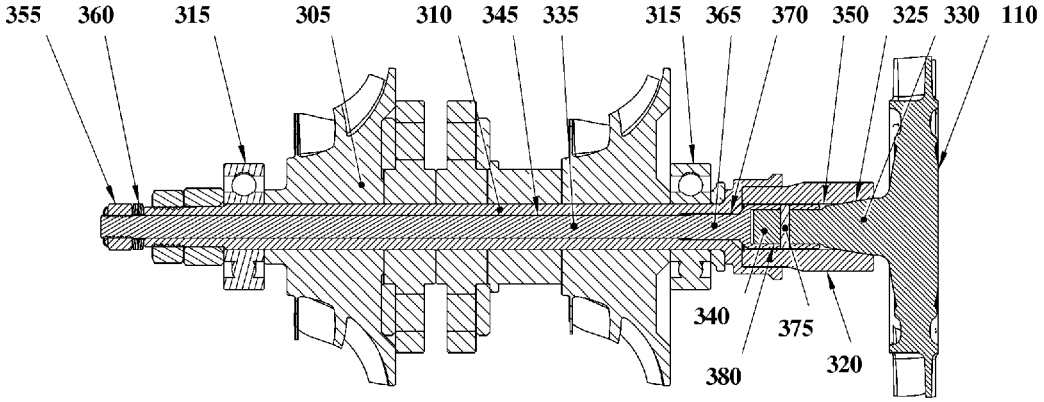
Figure 3C:
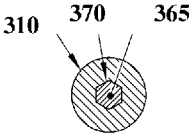

FIG. 3(*a*) is a side view of the exemplary rotor assembly 100 for a gas turbine engine, in accordance with an exemplary embodiment of the invention. FIG. 3(*b*) is a section view of the exemplary rotor assembly 100 for a gas turbine engine, in accordance with an exemplary embodiment of the invention. Specifically, FIG. 3(*b*) is a section view of section A-A of FIG. 3(*a*), which shows the cross-section created by an axial cut through the entire rotor assembly 100.

FIG. 3(*b*) shows a centrifugal impeller assembly 305, which can be mounted on a central shaft 310 supported by ball bearings 315. Other types of bearings, such as cylindrical roller, tapered roller, air film, oil journal, magnetic, etc., can also be used. As known to one of ordinary skill in the art, each of these types of bearings have one or more elements that can cease to function as designed if their temperature exceeds some prescribed value. For example, ball bearings can be lubricated with grease, which typically must be kept cooler than 80-120 degrees Celsius depending on the type used. Higher temperatures can compromise the service life of the grease; and therefore, must be avoided. On the opposite end of the spectrum, air bearings can tolerate much higher temperatures. However, even air bearings are generally made from thin metal foils, which typically have temperature limits in the 700-900 degrees Celsius range. These temperatures are still below the 1200-1400 degrees Celsius range in which a ceramic turbine is typically designed to operate. Furthermore, if these foils are coated with a solid lubricant, such as Teflon, to improve wear resistance during startup and shutdown, the temperature limit will be lower.

Regardless of the bearings' temperature limit, almost all turbomachines include a driven rotating component ("driven member), such as a compressor, generator, propeller, wheels, gearbox, etc., that is driven by a driving rotating component ("driving member"), such as the hot turbine rotor. In these turbomachines, it is necessary to keep the driven members relatively cool. Typically, the temperature limit in these devices is set by material limits. For example, the permanent magnets often used in high speed generators can become demagnetized if their temperature exceeds 80-150 degrees Celsius depending on the magnet grade; wire insulation typically cannot exceed 220 degrees Celsius; compressor impellers are often made from aluminum, which has creep strength limit of 350 degrees Celsius or less; and gearboxes will typically be lubricated by oil or grease that can have a temperature limit in the 100-300 degrees Celsius range. In addition to the temperature limits of the material used in the driving members, generators and compressors can be more efficient if operated at cooler temperatures.

Therefore, in accordance with an exemplary embodiment of the invention, a system for dramatically reducing heat conduction from the hot turbine rotor to the cool shaft can be provided. In an exemplary embodiment of the invention, the thermal insulation function can be provided by a rotating ceramic insulator 320 ("insulator"). In a preferred embodiment, the rotating ceramic insulator 320 can be generally cylindrical in shape, and can be rigidly joined to the central shaft 310, by a tight press fit, a shrink fit, an adhesive bond, or other similar fastening means.

In an alternative embodiment, the insulator need not be cylindrical, and can have a more complex cross-section, designed to create a longer and circuitous path for heat conducted from the turbine taper joint to the cool shaft assembly. Other insulator shapes can be utilized. Additionally, the insulator could also be joined to the cool shaft in a different way. For example, instead of a cylindrical joint and a press-fit or shrink-fit, a flange could be positioned at the cool end, with screws protruding through the holes in the flange to attach it to a matching flange on the rotating shaft. Other methods of joining the insulator to the cool shaft can be utilized.

In a preferred embodiment, the insulator 320 can be made from a ceramic material with high strength, stiffness, fracture toughness, and creep resistance at high temperature, low density, low cost, and very low thermal conductivity. For example, Zirconia ($ZrO_2$) can be an excellent choice because it meets all of these criteria. Partially stabilized forms of zirconia, such as yttria-stabilized zirconia (YSZ), can be advantageous. One of ordinary skill in the art will know that YSZ is typically tougher due to the transformation toughening effect of yttria. Another suitable ceramic material can be mullite ($3Al_2O_32SiO_2$). Mullite is inferior to zirconia in terms of thermal conductivity and strength; however, it can be superior in terms of cost, density, and creep resistance. Other ceramics materials may have similar and suitable properties, and could be utilized.

In addition to ceramic materials, the insulator 320 can be made from a metal. The disadvantage of typically higher thermal conductivity could be at least partially counteracted by designing the insulator 320 with thinner walls, if the particular metal used is strong enough and creep-resistant enough at high operating temperatures to allow this. One of ordinary skill in the art will understand that other different materials not described herein, can be utilized to make the insulator 320.

In an exemplary embodiment of the invention, a coupling mechanism, or coupling feature, between the main rotating shaft subassembly 215 and the turbine rotor/tension bolt subassembly 220 can be provided. Specifically, the coupling feature can include mating geometric surfaces on the driven member, i.e., main rotating shaft subassembly 215, and driving member, i.e., turbine rotor subassembly 220. In a preferred embodiment of the invention, the coupling feature does not permanently join or bond the main rotating shaft subassembly 215 and turbine rotor subassembly 220. The coupling mechanism can be configured to allow the driven and driving members to thermally expand and contract at different rates, i.e., allow for radial sliding so that when the turbine 110 gets hot there is some room for it to grow. However, despite allowing for radial sliding, the coupling mechanism can maintain precise relative centering, i.e., can be "self-centering," and can prevent relative rotation. Additionally, the coupling mechanism can allow for torque transmission. Finally, the coupling feature can be configured to provide a means to create and maintain an axial force between the driven and driving members, pulling them together and thus ensuring tight contact between the mating geometric surfaces, i.e., configured to have constraints against "pulling apart" in the axial direction.

In an exemplary embodiment of the invention, the coupling mechanism can be a taper bore and hex mechanism. The taper bore and hex will be discussed in reference to FIGS. 3(*b*) and 3(*c*). The insulator 320 can have a tapered bore 325 on its right end, the end that contacts the turbine shaft. The turbine shaft has a male tapered section 330 that matches the female bore in the ceramic insulator. The tapered bore 325 of the insulator, and the mating tapered shaft 330 of the turbine, serve to position the turbine rotor precisely. Concentricity, perpendicularity, and stiffness are ensured between the turbine rotor 110 and the shaft 310, as long as the turbine rotor 110 is seated tightly in the tapered bore 325.

To keep the turbine rotor 110 seated tightly in the tapered bore 325 may require an axial force that can pull the turbine rotor 110 towards the shaft subassembly 215, or towards the left side of the page as represented in FIG. 3(*b*). A long, slender tensioning bolt 335 can be utilized for this function. The tension bolt 335 can be rigidly and permanently bonded to the cylindrical shaft 340 protruding from the turbine rotor 110. The tension bolt's 335 slenderness can reduce the cross-sectional area for heat conduction, so that, even if made from a metal, the heat it conducts to the cool side of the rotor assembly 100 can be limited. Similarly, the cylindrical shaft portion 340 extending from the turbine rotor 110 can have a small diameter, advantageously reducing its cross-sectional area to limit the heat transfer rate. The diameters and cross sections can be much smaller than they would otherwise have been, if the ceramic insulator were not present to provide stiffness to the joint. For high speed rotating shafts, stiffness is crucial in order to prevent vibrations or whirling that would quickly destroy the rotor assembly 100.

On the opposite end from the turbine 110, threads can be provided on the tension bolt 335. The main central shaft 310 of the assembly can have a central bore 345 extending through its entire length, slightly larger in diameter than the body of the tension bolt 335. In a preferred embodiment, there can be just sufficient clearance between the tension bolt 335 and the central bore 345 to ensure that the parts can slide easily relative to each other. An unnecessarily large clearance in this area between the tension bolt 335 and the central bore 345 would most likely be undesirable because the slenderness of the tension bolt 335 would likely deflect substantially from the central axis of the rotor assembly 100, throwing off the balance. Corresponding to the bore 345 in the main shaft 310, the ceramic insulator 320 can require a bore 350, which is nominally generally cylindrical (excluding the previously mentioned tapered section 325).

To assemble the turbine/tension-bolt assembly 220 into the main rotating shaft assembly 215, forming a complete rotor assembly 100, the narrow, threaded end of the tension bolt 335 can be sequentially inserted through the bores 325, 350, and 345 in the ceramic insulator 320 and shaft 310. The tension bolt 335 can be long enough to protrude from the cool end of the shaft 310, exposing the threads. A nut 355 can be threaded onto the tension bolt 335 and tightened, creating tension that pulls the rotor assembly 100 together, seating the tapered turbine shaft 330 tightly into the tapered ceramic bore 325. Under the nut 355, it can be advantageous to place an elastic or spring-like element, such as Belleville disc washers 360. The disc washers 360 can provide additional compliance and thus ensure that the tension bolt 335 is always under some amount of tension, even when the shaft heats up and differential thermal expansion changes the length of the tension bolt 335 relative to the shaft assembly 215.

At some position along the tension bolt 335, it is advantageous to provide a mechanical feature to transmit torque to the main shaft assembly 215. FIG. 3(*c*) is another section view of the exemplary rotor assembly 100 for a gas turbine engine, in accordance with an exemplary embodiment of the invention. Specifically, FIG. 3(*c*) is a section view of section B-B of FIG. 3(*a*), which shows a radial cut through a hexagonal feature that facilitates torque transmission from subassembly 220 to subassembly 215.

In an exemplary embodiment of the invention, the torque transmitting feature can be a male hex or a spline feature 365. The shaft 310 can have a mating female hex or spline 370. These features can be located in the same axial position in the shaft assembly, so that they can mate with each other to transmit torque from the turbine/bolt 220 to the main shaft assembly 215 when the two are assembled. Without a feature like this, the friction in the tapered joint 330/325 would still serve to transmit some torque; however, a spline, hex, or other non-circular feature can transmit substantially more.

In an alternative embodiment, the male hex or a spline feature 365 can be located in a different area. For example, the cylindrical bore 350 of the ceramic insulator 320 can be replaced by a square, hexagon, spline, or other geometry, and the outer periphery of the socket 380 in the tension bolt 335 can have a matching geometry. Therefore, torque could be transmitted from the turbine 110 to the insulator 320 and from there to the rotating shaft 310. An advantage of this approach can be the elimination of any contact between the tension bolt 335 and the metal rotating shaft 310 near the bearing 315, which can reduce heat transfer substantially. However, a disadvantage would be the added complexity in the shape of the insulator 320, making it a little more difficult to fabricate, though with little cost difference due to this change.

In another alternative embodiment, the tapered cylindrical joint combined with the separate torque coupling can be combined into one joint. For example, a male tapered hexagonal protrusion can be provided on the turbine rotor 110, and a matching tapered female hexagonal hole can be provided in the end of the ceramic insulator 320. This alternative embodiment might confer substantial advantages in terms of reducing heat transfer, improving torque capacity, and simplifying the joint, at the cost of additional fabrication difficulty for the ceramic insulator 320 and the ceramic turbine 110. However, in production, if these components are fabricated by a molding process of some kind, fabrication may not be any more difficult than in the design pictured in the figures.

The permanent bond between the turbine 110 and the tension bolt 335 can be made by a press fit, shrink fit, high temperature ceramic adhesive, brazed joint, pin, or other fastening method. Additionally, a combination of these methods could also be used. For example, the joint shown in FIG. 3(*b*) is a tight press fit, along with a pin 375. For example, the pin 375 can be an ordinary stainless steel dowel pin or roll pin. The pin 375 can extend radially through both the turbine shaft 340 and a socket 380 in the tensioning bolt 335, locking them together in both the axial and tangential directions. The friction of the tight press fit between socket 380 and turbine shaft 340 can also serve these functions; and additionally, can ensure excellent concentricity and prevent any looseness or play in the joint. However, the pin 375, or other positive, secure mechanical joining means, is not redundant. The pin 375 is advantageous because it can ensure that vibration, repeated thermal expansion/contraction cycles, and the like, cannot cause the turbine shaft 340 to slowly "wiggle out," and eventually separate from the socket 380 in the tension bolt 335. Although the pin/press-fit joint is described here by way of example, those skilled in the art may be able to envision other adequate joining methods to connect the tension bolt 335 to the turbine shaft 340.

In a preferred embodiment, the tension bolt 335 can be made from a material that is strong, tough, and machinable, such as a metal. Additionally, the metal would have a coefficient of thermal expansion (CTE) that approximately matches that of the ceramic turbine shaft. Presently, the most highly developed ceramic material for turbine applications is sintered silicon nitride, $Si_3N_4$. Silicon nitride has a very low CTE, only about $3.1*10^{-6}$ meters per meter*m-° C., a factor of four less than steel and most other metals. Metals with CTEs that are close to that of silicon nitride include the following: tungsten (4.4 μm/m-K), Invar, also known generically as 64FeNi, (averaging 2.5 μm/m-° C. at temperatures ranging from 0-200° C.), and molybdenum (averaging 6.0 μm/m-° C. from 0-500° C.).

In an alternative embodiment, the tension bolt 335 could be made from some other material, rather than a low-CTE metal, and might not necessarily be joined to the turbine rotor as described previously. The primary function of the tension bolt is to pull the turbine rotor tightly into the tapered bore in the insulator, and to maintain this tension while the assembly is in operation. The tension bolt can conceivably be replaced with a wire or non-rigid element. Whether rigid or flexible, the tension bolt can be made from a higher-CTE material, as long as the joint with the turbine shaft can accommodate differential thermal expansion in some way.

Depending on the bonding method utilized between the turbine 110 and the tension bolt 335, matching the material CTEs between the ceramic and metal may not be mandatory. For example, with the pin/press-fit joint described above, differential thermal expansion can be tolerated because the pin can ensure that the tension bolt is always pulling the turbine tight in the tapered bore of the ceramic insulator, even if differential thermal expansion loosens the press-fit cylindrical joint between the turbine shaft 340 and the tension bolt socket 380. The pin 375 can also transmit torque from the turbine 110 to the tension bolt 335, through the spline or hex 365, to the main shaft assembly, regardless of the looseness of the cylindrical joint fit.

As discussed herein with respect to FIGS. 1-3, a taper bore and hex coupling mechanism was described as the connection between the main rotating shaft subassembly 215, and the turbine rotor subassembly 220, in accordance with an exemplary embodiment of the invention. In an alternative exemplary embodiment of the invention, the coupling mechanism, or coupling feature, can be a Hirth Serration coupling, known to one of ordinary skill in the art. The Hirth Serration coupling mechanism will be discussed in reference to FIGS. 4-6 below. Furthermore, where applicable, differences between the taper bore and hex coupling embodiment and the Hirth Serration coupling embodiment will be described. One of ordinary skill in the art will understand that there are also similarities between these two embodiments, and the description of similar components will not necessarily be repeated herein.

Figure 4:
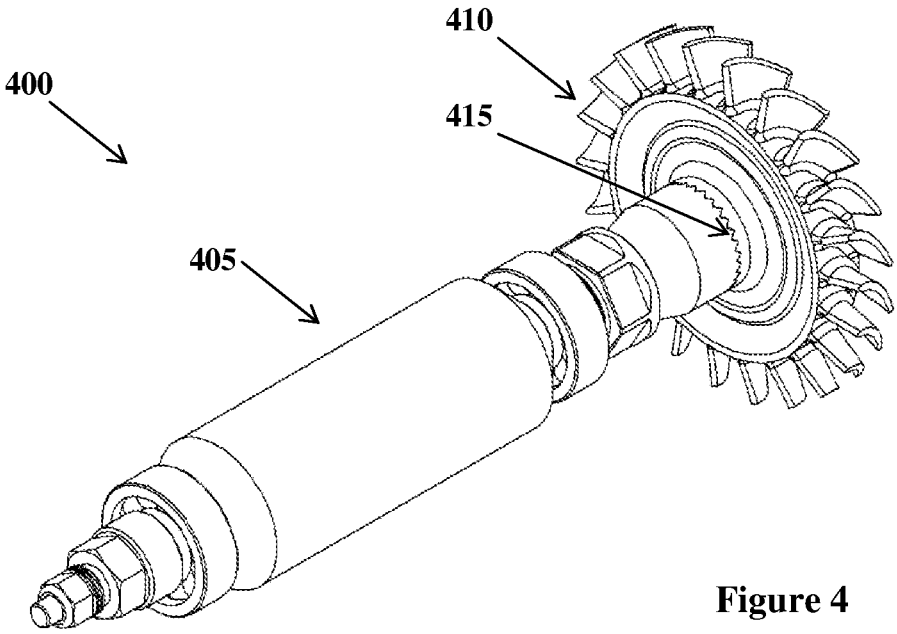
FIG. 4 shows an isometric view of an exemplary rotor assembly for a gas turbine engine, in accordance with an alternative exemplary embodiment of the invention.

FIG. 4 is an isometric view of an exemplary rotor assembly 400 for a gas turbine engine, in accordance with an alternative exemplary embodiment of the invention. The rotor assembly 400 can include a driven member component 405, such as a compressor, generator, propeller, wheels, gearbox, etc., and a driving member component 410, such as the single stage axial flow turbine rotor shown in FIG. 4. However, one of ordinary skill in the art would understand that a rotor assembly with different types, and different quantities, of components could also be utilized s long as there is at least one high speed, high-temperature rotating component such as a turbine, and at least one high speed rotating component that needs to stay comparatively cool.

Figure 5:
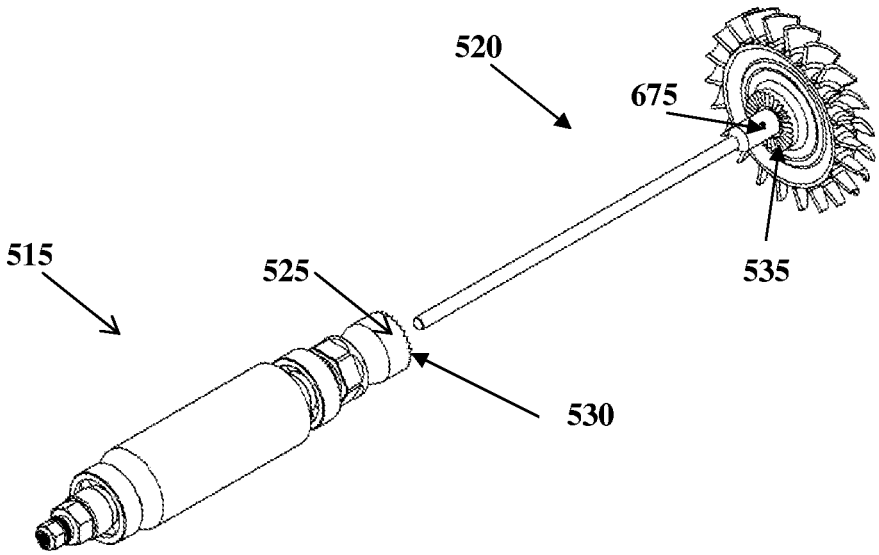
FIG. 5 is an exploded view of the exemplary rotor assembly for a gas turbine engine, in accordance with an alternative exemplary embodiment of the invention.

FIG. 5 is an exploded view of the exemplary rotor assembly 400 for a gas turbine engine, in accordance with an alternative exemplary embodiment of the invention. In FIG. 5, the view reflects the rotor assembly 400 after separating it into two main subassemblies: a main rotating shaft subassembly 515, and a turbine rotor/tension bolt subassembly 520.

Figure 6A:
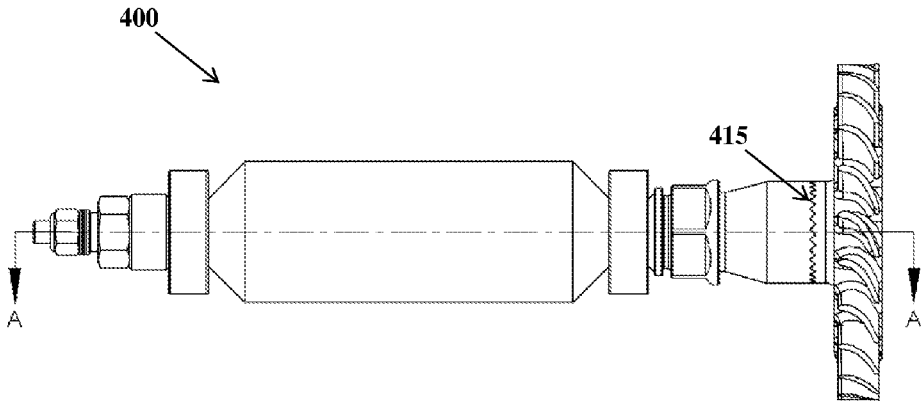
FIG. 6(*a*) is a side view of the exemplary rotor assembly for a gas turbine engine, in accordance with an alternative exemplary embodiment of the invention.
Figure 6B:
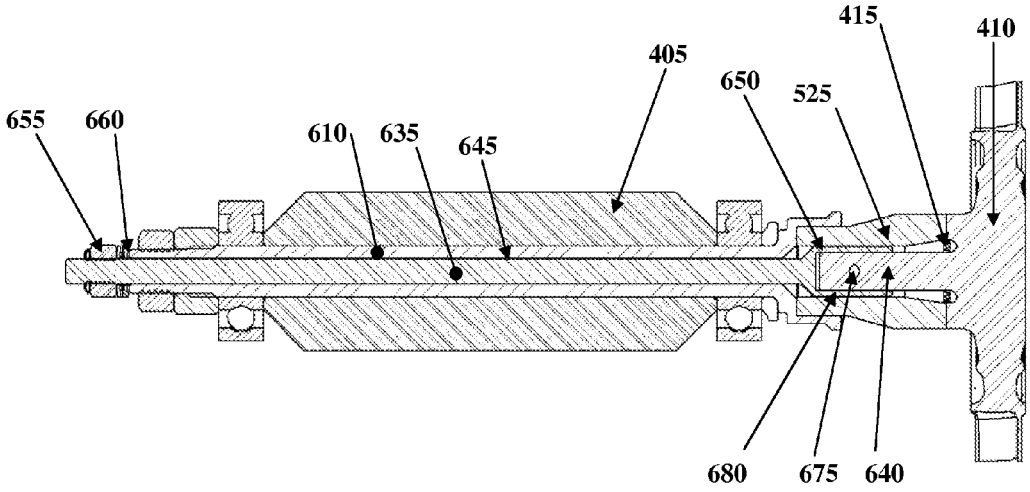

FIG. 6(*a*) is a side view of the exemplary rotor assembly 400 for a gas turbine engine, in accordance with an alternative exemplary embodiment of the invention. FIG. 6(*b*) is a section view of the exemplary rotor assembly 400 for a gas turbine engine, in accordance with an alternative exemplary embodiment of the invention. Specifically, FIG. 6(*b*) is a section view of section A-A of FIG. 6(*a*), which shows the cross-section created by an axial cut through the entire rotor assembly 400.

In accordance with an alternative exemplary embodiment of the invention, a thermal insulation function can be provided by a rotating ceramic insulator 525 ("insulator"). In a preferred embodiment, the rotating ceramic insulator 525 can be generally cylindrical in shape, and can be rigidly joined to a central shaft 610, by a tight press fit, a shrink fit, an adhesive bond, or other similar fastening means.

In an exemplary embodiment of the invention, a coupling mechanism, or coupling feature, between the main rotating shaft subassembly 515 and the turbine rotor/tension bolt subassembly 520 can be provided. Specifically, the coupling feature can include mating geometric surfaces on the driven member, i.e., main rotating shaft subassembly 515, and driving member, i.e., turbine rotor subassembly 520. In a preferred embodiment of the invention, the coupling feature does not permanently join or bond the main rotating shaft subassembly 515 and turbine rotor subassembly 520. The coupling mechanism can be configured to allow the driven and driving members to thermally expand and contract at different rates, i.e., allow for radial sliding so that when the turbine 410 gets hot there is some room for it to grow. However, despite allowing for radial sliding, the coupling mechanism can maintain precise relative centering, i.e., can be "self-centering," and can prevent relative rotation. Additionally, the coupling mechanism can allow for torque transmission. Finally, the coupling feature can be configured to provide a means to create and maintain an axial force between the driven and driving members, pulling them together and thus ensuring tight contact between the mating geometric surfaces, i.e., configured to have constraints against "pulling apart" in the axial direction.

In an alternative exemplary embodiment of the invention, the coupling mechanism can be a Hirth Serration coupling 415, known to one of ordinary skill in the art. In general, a Hirth Serration coupling can be used to connect two pieces of a shaft together, and is characterized by teeth that mesh together on the end faces of each half shaft. In this exemplary embodiment, the Hirth Serration coupling can be used to connect the turbine rotor/tension bolt subassembly 520 to the main rotating shaft subassembly 515.

In an exemplary embodiment of the invention, the insulator 525 can have teeth machined into the ceramic material on its face. Additionally, the turbine 410 can have teeth machined on its face. FIG. 5 depicts the teeth 530 on the face of the insulator 525 and the teeth 535 on the face of the turbine 410. In an exemplary embodiment, the two faces can be pushed together so that the two sets of teeth 530 and 535 can form-lock. A unique advantage of the Hirth Serration coupling 415 is that it can transmit torque to the main shaft assembly 515 because of the interlocking teeth.

To keep the two sets of teeth 530 and 535 locked together, an axial force is required that can pull the turbine rotor 410 towards the shaft subassembly 515, or towards the left side of the page as represented in FIG. 6(*b*). A long, slender tensioning bolt 635 can be utilized for this function. The tension bolt 635 can be rigidly and permanently bonded to the shaft protruding from the turbine rotor 410. On the opposite end from the turbine 410, threads can be provided on the tension bolt 635. The main central shaft 610 of the assembly can have a central bore 645 extending through its entire length, slightly larger in diameter than the body of the tension bolt 635. In a preferred embodiment, there can be just sufficient clearance between the tension bolt 635 and the central bore 645 to ensure that the parts can slide easily relative to each other. An unnecessarily large clearance in this area between the tension bolt 635 and the central bore 645 would most likely be undesirable because the slenderness of the tension bolt 635 would likely deflect substantially from the central axis of the rotor assembly 400, throwing off the balance. Corresponding to the bore 645 in the main shaft 610, the ceramic insulator 525 can require a bore 650, which is nominally generally cylindrical.

To assemble the turbine/tension-bolt assembly 520 into the main rotating shaft assembly 515, forming a complete rotor assembly 400, the narrow, threaded end of the tension bolt 635 can be sequentially inserted through the bores 650 and 645 in the ceramic insulator 525 and shaft 610. The tension bolt 635 can be long enough to protrude from the cool end of the shaft 610, exposing the threads. A nut 655 can be threaded onto the tension bolt 635 and tightened, creating tension that pulls the rotor assembly 400 together, seating the two faces so that the two sets of teeth 530 and 535 can be pushed together. Under the nut 655, it can be advantageous to place an elastic or spring-like element, such as Belleville disc washers 660, also known generically as coned-disc springs. The disc washers 660 can provide additional compliance and thus ensure that the tension bolt 635 is always under some amount of tension, even when the shaft heats up and differential thermal expansion changes the length of the tension bolt 635 relative to the shaft assembly 515.

The permanent bond between the turbine 410 and the tension bolt 635 can be made by a press fit, shrink fit, high temperature ceramic adhesive, brazed joint, pin, or other fastening method. Additionally, a combination of these methods could also be used. For example, the joint shown in FIG. 6(*b*) is a tight press fit, along with a pin 675. For example, the pin 675 can be an ordinary stainless steel dowel pin or roll pin. The pin 675 can extend radially through the turbine shaft 640 and a socket 680 in the tensioning bolt 635, locking them together in both the axial and tangential directions. The friction of the tight press fit between socket 680 and turbine shaft 640 can also serve these functions; and additionally, can ensure excellent concentricity and prevent any looseness or play in the joint. However, the pin 675, or other positive, secure mechanical joining means, is not redundant. The pin 675 is advantageous because it can ensure that vibration, repeated thermal expansion/contraction cycles, and the like, cannot cause the turbine shaft 640 to slowly "wiggle out," and eventually separate from the socket 680 in the tension bolt 635. Although the pin/press-fit joint is described here by way of example, those skilled in the art may be able to envision other adequate joining methods to connect the tension bolt 635 to the turbine shaft 640.

In summary, the exemplary embodiments of the invention described herein offer numerous improvements over prior art methods for mounting ceramic turbines, and other hot, rotating, low-CTE components, to metal shafts. For example, the design of the rotor assembly 100 and 400 can allow it to be repeatedly disassembled and reassembled. In contrast, the prior art methods typically use brazing, which is a permanent joint. The ability to repeatedly disassemble and reassemble is a unique advantage because it can facilitate maintenance, balancing, and inspection of the rotor assembly 100 and 400. It can also provide design freedom for the surrounding stationary mechanical components, allowing them to be simplified, or manufactured via a cheaper process.

Another advantage of the invention is that it can inherently tolerate differential thermal expansion. For example, the turbine rotor can heat up or cool down at a faster or slower than the ceramic insulator, and it may be made from a material with a very different CTE from the insulator, yet the two components can remain precisely and rigidly positioned in both embodiments described herein. The two components are free to expand and shrink, sliding relative to each other along the conical surface of the taper joint, or along the generally radial faces of the Hirth Serration coupling in the alternative embodiment, yet the joint or Hirth Serration coupling will still position the two components rigidly and precisely with respect to each other.

In contrast, brazing or bonding a ceramic rotor to a metal shaft with a very different CTE can be very challenging, requiring a high degree of engineering skill, and often, substantial design compromises to achieve adequate performance and reliability. The joint must be designed carefully, often using finite element analysis, with compliant elements that absorb differential thermal, thin-section regions of the metal or ceramic shaft, and special brazing materials and processes. Even so, thermal strains due to mismatched CTEs still inherently cause large stresses, and sometimes unavoidable reliability problems, for brazed, bonded, or other permanent/rigid types of joints.

A third advantage in accordance with the exemplary embodiments of the invention, is that it can provide a degree of insulation between the hot and cool rotating components that is difficult to match by prior art methods. In typical operation, the turbine rotor 110 and 410 in both embodiments can exceed 1300° C. The bearings, which are positioned approximately 30 mm from the turbine rotor 110 and 410 in both embodiments, must be held below 120° C. to avoid damaging the lubricant. In the exemplary embodiments of the invention, the estimated heat transfer rate via conduction through the insulator 320 and 525 is only about 21 watts. This makes it much easier to keep the bearings cool than it would be in a corresponding prior art brazed metal shaft assembly of similar geometric proportions. In the latter case, heat conduction to the bearings would typically be about 100-200 watts due to the higher thermal conductivity of the metal.

The estimated heat transfer through the insulator 320 or 525 can be calculated as follows. The length L of the ceramic insulator, is approximately 17 mm; the maximum outside diameter $D_1$ of the insulator is approximately 15.5 mm, and the inside diameter $D_2$ is approximately 8 mm. The heat transfer problem can be approximated as a simple conduction through a cylinder, and the estimated heat transfer rate through the insulator via conduction can be $Q_{cond}=k*A_{cs}*\Delta T/L$, where k=2.2 W/m° C., which is the average thermal conductivity of zirconia; $A_{cs}=\pi/4*(D_1^2-D_2^2)$, which is the cross-sectional area of the insulator; and $\Delta T$=1300° C.-120° C.=1180° C. can be the approximate worst-case temperature difference from the hot end to the cold end.

Finally, in accordance with the exemplary embodiments of the invention, the rotors can be unusually short and stiff, which can enable superior shaft dynamics properties relative to what is practical in prior art designs. The short axial length can be due to the thermal insulation and inherent tolerance of differential thermal expansion as described herein. The high degree of stiffness can be because the outside diameter of the ceramic insulator can be larger than is practical with metal joints, for the same reasons.

It should be understood that the foregoing relates only to illustrative embodiments of the present invention, and that numerous changes may be made therein without departing from the scope and spirit of the invention as defined by the following claims.

The invention claimed is:

1. A rotor assembly, comprising:
at least one driven member;
at least one driving member;
at least one rotating thermal insulator rigidly attached to the driven member, wherein the rotating thermal insulator is made from a ceramic material; and
a coupling feature comprising mating geometric surfaces on the driven member and the driving member, wherein the geometric surfaces are configured to allow radial sliding, relative centering, torque transmission, and axial constraint between the driven member and the driving member.

2. The rotor assembly of claim 1, wherein the driven member is a compressor rotor.

3. The rotor assembly of claim 1, wherein the driven member is a generator rotor.

4. The rotor assembly of claim 1, wherein the driving member is a turbine.

5. The rotor assembly of claim 1, wherein the coupling feature is a taper bore and hex coupling mechanism.

6. The rotor assembly of claim 1, wherein the coupling feature is a Hirth serration coupling mechanism.

7. A method of reducing heat transfer in a rotor assembly, comprising the steps of:
rigidly attaching a rotating thermal insulator to a driven member or a driving member, wherein the rotating thermal insulator is made from a ceramic material; and
coupling the driven member to a driving member with a coupling feature, wherein the coupling feature is configured to allow radial sliding, relative centering, torque transmission, and axial constraint between the driven member and the driving member.

8. A rotor assembly, comprising:
at least one driven member;
at least one driving member;
at least one rotating insulator rigidly attached to the driven member, wherein the rotating thermal insulator is made from a ceramic material;
a coupling feature comprising mating geometric surfaces on the driven member and the driving member, wherein the geometric surfaces are configured to allow the driven member and the driving member to thermally expand and contract at different rates, maintain relative centering, and prevent relative rotation;
and means to maintain an axial force between the driven member and the driving member.

9. The rotor assembly of claim 1, wherein the ceramic material of the rotating thermal insulator comprises one of zirconia, yttria-stabilized zirconia, or mullite.

* * * * *